US007364469B2

(12) United States Patent
Huffman et al.

(10) Patent No.: US 7,364,469 B2
(45) Date of Patent: Apr. 29, 2008

(54) ELECTRICAL CONNECTOR FOR USE WITH NATO EQUIPMENT

(75) Inventors: Scott Huffman, Delaware, OH (US); Mark Huffman, Woodstock, GA (US)

(73) Assignee: Graywacke Engineering, Inc., Delaware, OH (US)

( * ) Notice: Subject to any disclaimer, the term of this patent is extended or adjusted under 35 U.S.C. 154(b) by 0 days.

(21) Appl. No.: 11/536,717

(22) Filed: Sep. 29, 2006

(65) Prior Publication Data

US 2007/0099488 A1 May 3, 2007

Related U.S. Application Data

(60) Provisional application No. 60/723,229, filed on Oct. 3, 2005.

(51) Int. Cl.
*H01R 24/00* (2006.01)

(52) U.S. Cl. ..... 439/675; 439/483; 439/604

(58) Field of Classification Search ..... 439/578, 439/675, 488, 483, 604
See application file for complete search history.

(56) References Cited

U.S. PATENT DOCUMENTS 3,452,321 A * 6/1969 Carissimi et al. ..... 439/483
3,721,939 A * 3/1973 Paugh ..... 439/354
3,893,743 A * 7/1975 Wallo ..... 439/578
D242,464 S * 11/1976 Acosta ..... D13/138.1
4,386,818 A * 6/1983 Millhimes et al. ..... 439/490
5,340,330 A * 8/1994 Dolson et al. ..... 439/447
5,932,841 A * 8/1999 Matsumoto et al. ..... 174/359
6,115,277 A 9/2000 Plichta et al.
6,172,892 B1 1/2001 Plichta et al.
6,220,888 B1 * 4/2001 Correa ..... 439/445
6,363,272 B1 * 3/2002 Combs ..... 600/376
6,559,556 B1 5/2003 Wills
6,602,088 B1 * 8/2003 Zhu ..... 439/382
7,186,137 B2 * 3/2007 Rock ..... 439/502

* cited by examiner

*Primary Examiner*—Neil Abrams
(74) *Attorney, Agent, or Firm*—Timothy D. Bennett

(57) ABSTRACT

A NATO slave connector may include a 2-conductor cable designed to permit a maximum current draw of about 35 amperes. The connector may also include: a connection end adapted to connect to a military vehicle's 24 volt battery NATO slave receptacle; a cable end adapted to be electrically wired to a device; and, a protective covering on the outer surface of the connector.

11 Claims, 6 Drawing Sheets

ELECTRICAL CONNECTOR FOR USE WITH NATO EQUIPMENT

This application claims priority to U.S. Ser. No. 60/723.229, entitled NATO SLAVE CONNECTOR, filed Oct. 3, 2005, which is incorporated herein by reference.

I. BACKGROUND OF THE INVENTION

A. Field of Invention

This invention pertains to the art of methods and apparatuses regarding electrical connectors and cables, and more specifically to methods and apparatus regarding a NATO slave connector designed to connect to a universal NATO slave receptacle typically found on military vehicles.

B. Description of the Related Art

It is known in the art of military vehicles, such as the North Atlantic Treaty Organization (NATO) Humvee, to have a 24 volt direct current (DC) battery supply. This battery supply is typically used to provide power to various devices, such as to charge other batteries, computer systems, etc. As a result, such vehicle batteries typically have a power receptacle typically referred to as a NATO slave receptacle. It is also known to provide a NATO standardized DC slave connector that fits the NATO slave receptacle so that power can be extracted therefrom.

Many known NATO slave connectors work well for their intended purpose. They also have problems, however. These known problems include: (1) they tend to corrode easily; (2) their wiring is relatively difficult to connect; (3) they are not sufficiently durable; and (4) they tend to fray. Another problem is related to the fact that known NATO slave connectors are designed to carry large ampere (amp) loads, often 50 amps and above. These connectors are relatively large and expensive when the required amp loading is smaller.

The present invention provides methods and apparatuses for a NATO slave connector that overcomes the foregoing difficulties and others while providing better and more advantageous overall results.

II. SUMMARY OF THE INVENTION

One advantage of the NATO slave connector according to one embodiment of this invention is that the brass hardware may be zinc plated thereby preventing corrosion.

Another advantage of the NATO slave connector according to another embodiment of this invention is that it may include a dimple design which assures broad contact over the male connector.

Still another advantage of the NATO slave connector according to another embodiment of this invention is that it may use 2-conductor 10 gage copper cable to make the wiring hook up easier.

Another advantage of the NATO slave connector according to another embodiment of this invention is that it may be formed from a relatively harder plastic to provide increased durability.

Another advantage of the NATO slave connector according to yet another embodiment of this invention is that it may provide strain relief, thereby preventing the fraying of the cable.

Still another advantage of the NATO slave connector according to another embodiment of this invention is that it may permit a maximum current draw of 35 amps thereby proving a connector of compact size and having a low cost.

Still other benefits and advantages of this invention will become apparent to those skilled in the art to which it pertains upon a reading and understanding of the following detailed specification.

III. BRIEF DESCRIPTION OF THE DRAWINGS

The invention may take physical form in certain parts and arrangement of parts, embodiments of which will be described in detail in this specification and illustrated in the accompanying drawings which form a part hereof and wherein.

IV. DETAILED DESCRIPTION OF THE INVENTION

Figure 1:
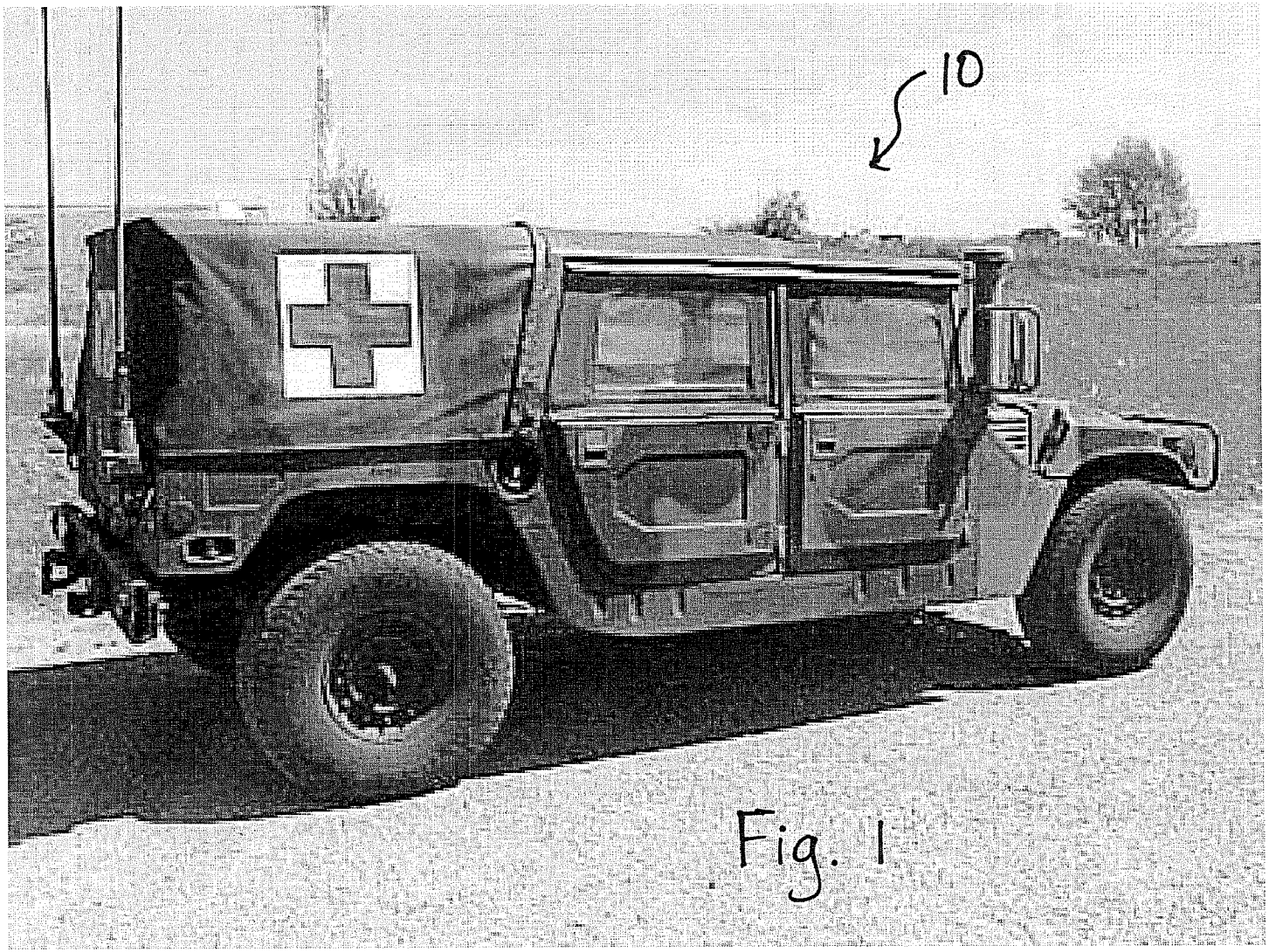
FIG. 1 is a perspective side view of a military vehicle having a battery and a NATO slave receptacle that may connect to the NATO slave connector of this invention.
Figure 2A:
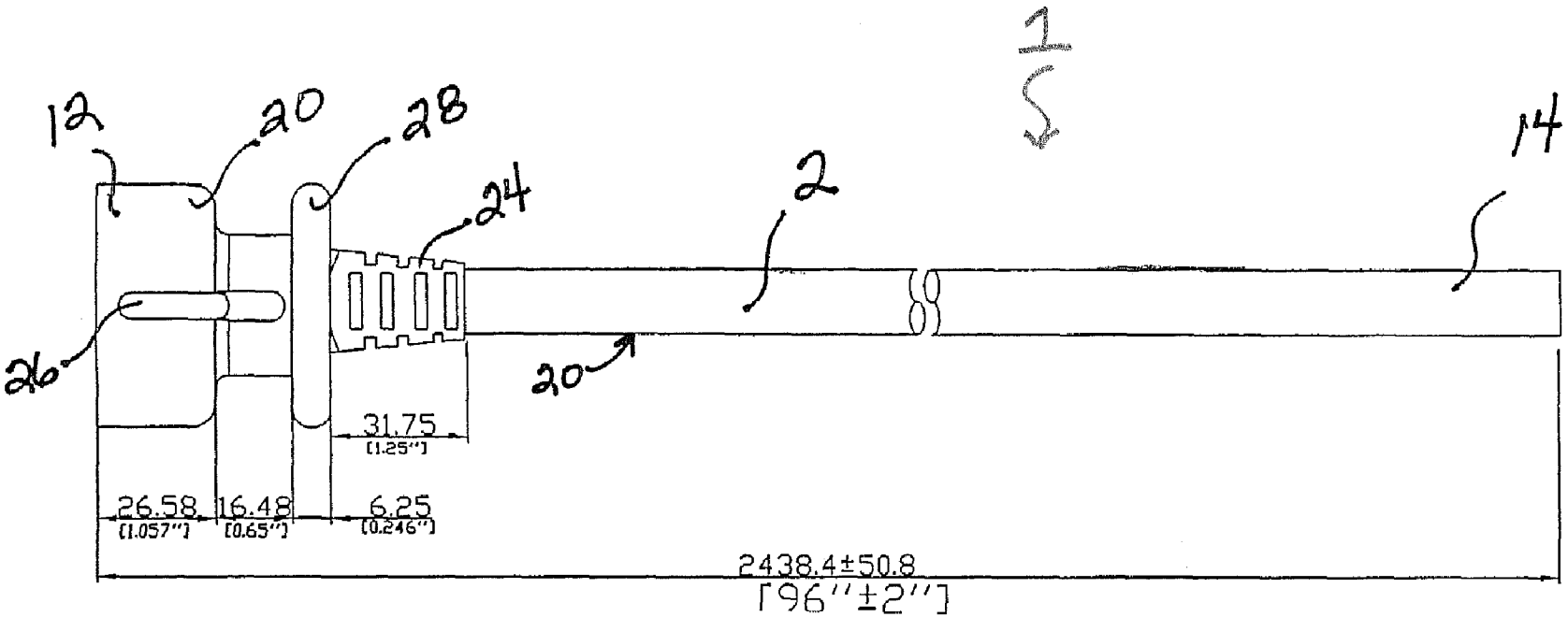
FIG. 2A is a side view of a connector according to one embodiment of this invention.
Figure 2B:
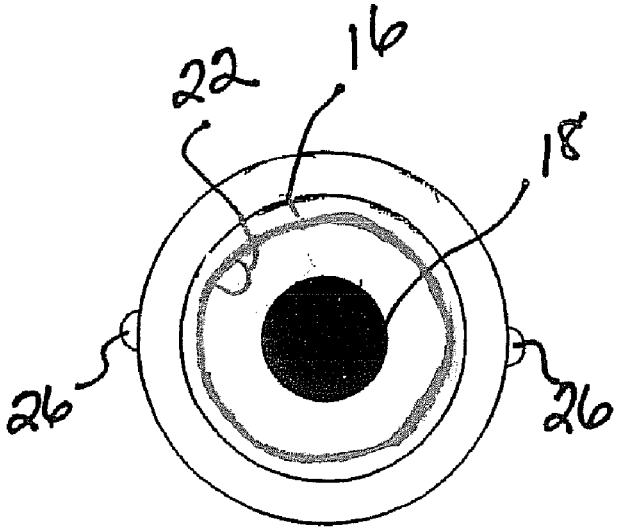
FIG. 2B is an end view of a connector showing the connection end.
Figure 2C:
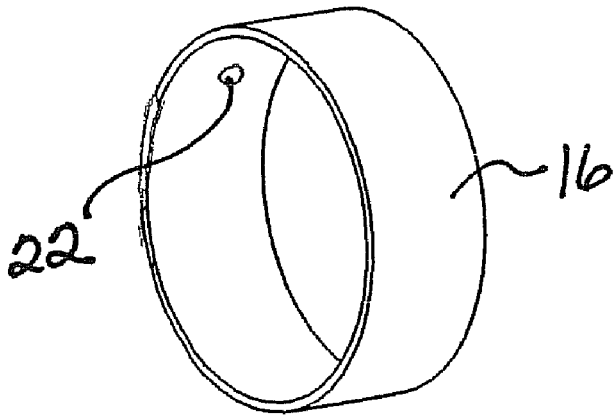
FIG. 2C is a perspective view of a ring member according to one embodiment of this invention.
Figure 2D:
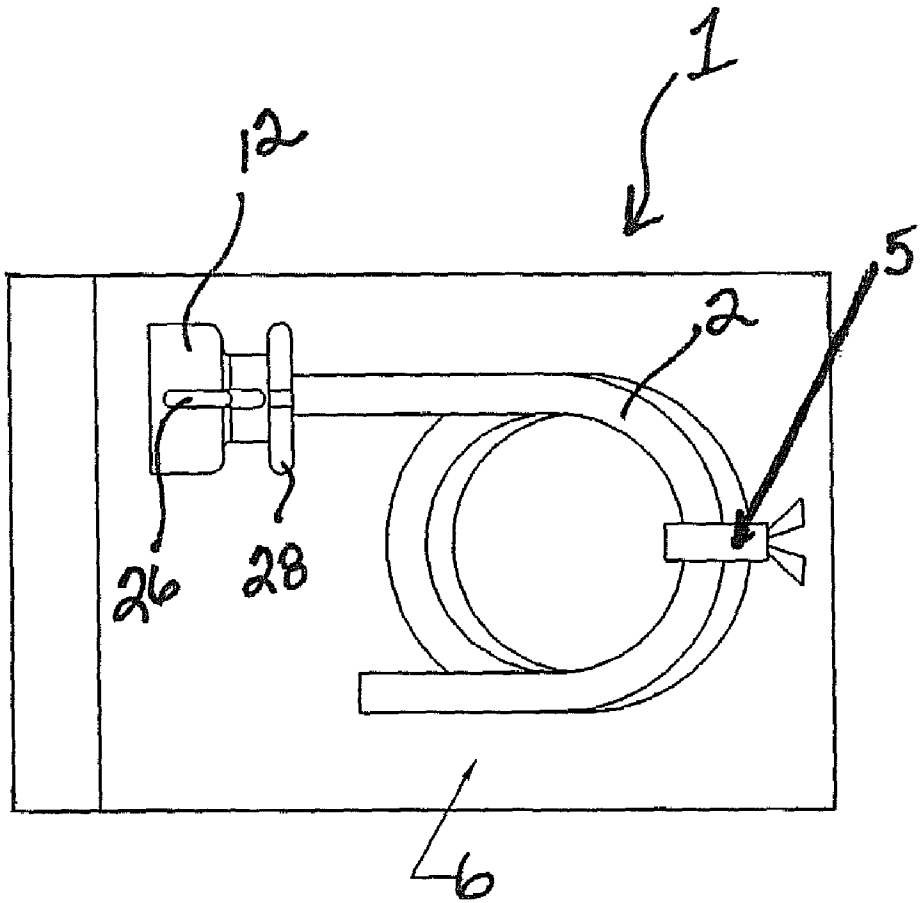
FIG. 2D is a side view of a connector according to another embodiment of this invention showing the connector in a storage bag.
Figure 3:
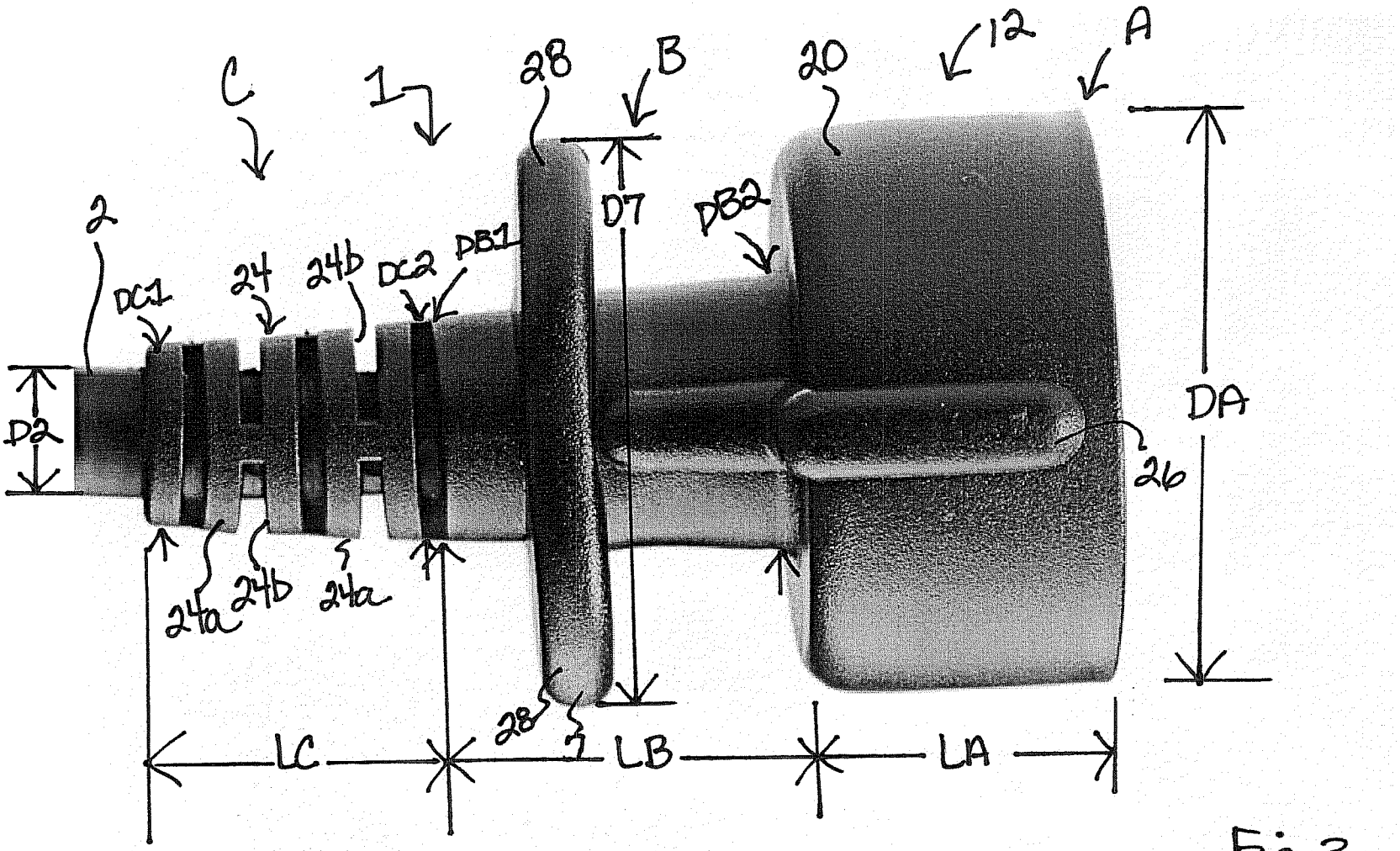
FIG. 3 is a perspective side view of yet another embodiment connector of this invention.
Figure 4:
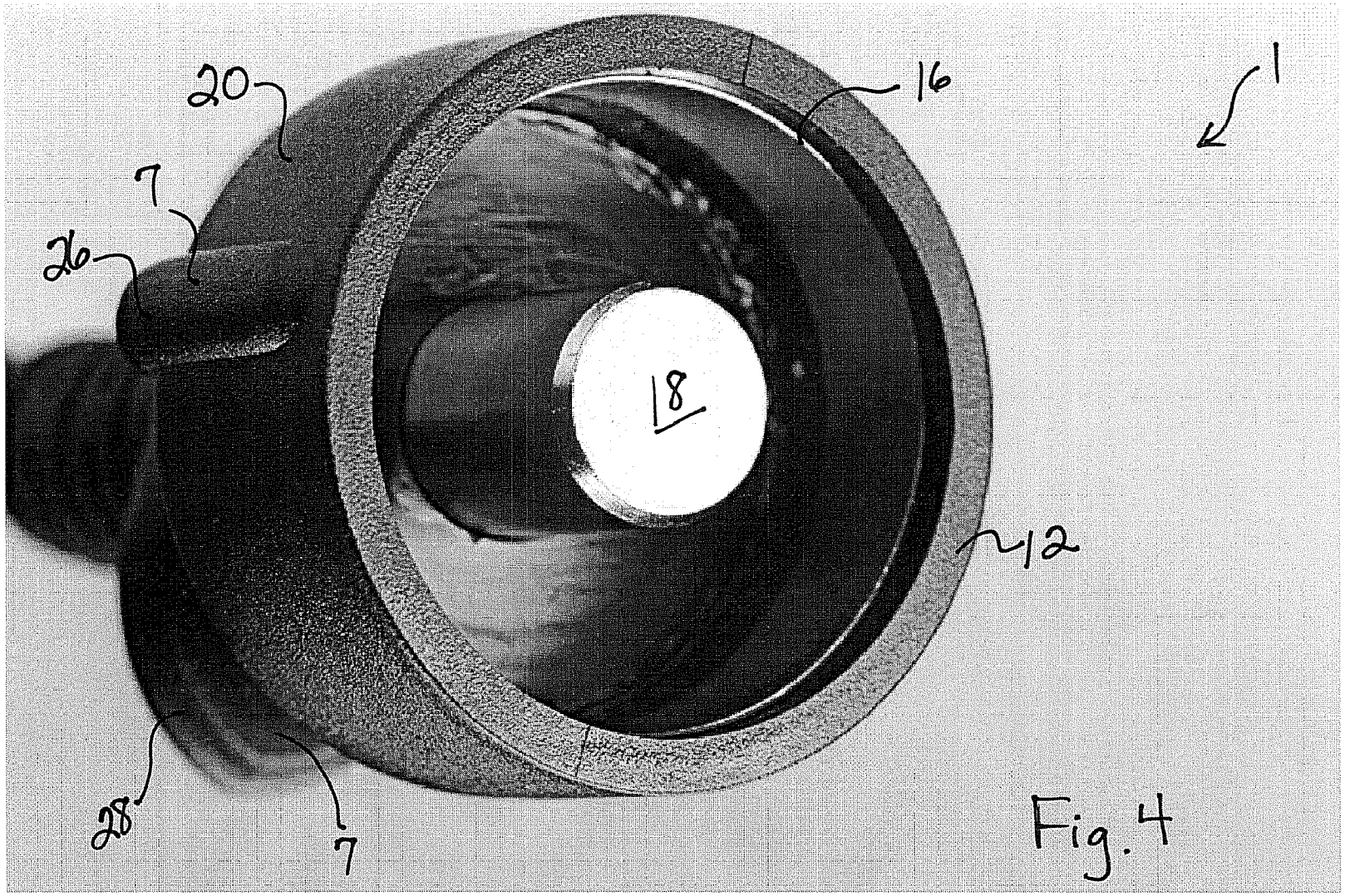
FIG. 4 is a perspective end view of the connector shown in FIG. 3.

Referring now to the drawings wherein the showings are for purposes of illustrating embodiments of the invention only and not for purposes of limiting the same, FIG. 1 shows a military vehicle 10 equipped with a battery (not shown) and a NATO slave receptacle (not shown) that may connect to the connectors 1, shown in FIGS. 2-4, of this invention. It is to be understood that the military vehicle 10 is exemplary only as the connector 1 of this invention may be used with other vehicles and in non-vehicle applications as well.

With reference to FIGS. 2A, 2D and 3, the connector 1 includes a cable 2, a connection end 12 that connects to the vehicle's receptacle (not shown), and a cable end 14 that can be wired to any device chosen with sound engineering judgment. Non-limiting examples of devices that the cable end 14 may be electrically connected to include inverters, motors and converters. The cable 2 may have an outer diameter D2 and, in one embodiment, may use 2-conductor cable. In a more specific embodiment, the cable 2 may use 2-conductor 10 gage copper wire/cable to make the wiring hook up easier. In another embodiment, the connector 1 can be used as an "extension cord" to extend the reach of the vehicle's battery. Thus, for one non-limiting example, the connector 1 can be used to connect a 24 volt (DC) battery power source positioned on the passenger side of a military hummer to a communication tent 25 feet away. In one embodiment, a protective covering 20 may be provided on the outer surface of the connector 1. The protective covering 20 may be formed of any material that provides adequate insulation. In a more specific embodiment, the covering 20 may be formed of a hard plastic, such as polyvinyl chloride (PVC), to provide increased durability.

With reference now to FIGS. 2A, 2B, 2C, 2D, 3 and 4, The connection end 12 may include a ring member 16 and a contact pole 18 axially centered within the ring member 16, as shown, to connect to the NATO slave receptacle. In one embodiment, both the ring member 16 and the contact pole 18 may be formed of copper with brass plated nickel to provide appropriate electric conductivity. It is noted, however, that other materials may be used as long as they provide adequate electric conductivity. In one embodiment, the ring member 16 and the contact pole 18 are zinc plated to prevent corrosion. In another embodiment, a least one dimple 22 extends inwardly from the inner surface of the ring member 16. The dimple 22 provides an electric contact surface that improves the connection between the connector 1 and the corresponding male component of the vehicle's receptacle.

With reference now to FIGS. 3 and 4, the connection end 12 may include three sections A, B, and C, along its length. Section A is at the terminal end and encompasses the ring member 16 and contact pole 18. Section A may have a substantially cylindrical outer shape with a length LA and an outer diameter DA. Section B is juxtaposed at one end to section A and may have a substantially frusto-conical shape with a length LB, a minimum outer diameter DB1 and a maximum outer diameter DB2. In an alternate embodiment, section B may have a substantially cylindrical outer shape with a constant outer diameter. In one embodiment, shown, the maximum outer diameter DB2 is substantially smaller than the outer diameter DA of section A. This reduces material and thus cost. The embodiment shown also illustrates that the minimum outer diameter DB1 is substantially larger than the outer diameter D2 of the cable 2. This provides structural rigidity to the connection end 12. Section C is juxtaposed at one end to section B and at the opposite end to the cable 2. Section C may have a substantially frusto-conical shape with a length LC, a minimum outer diameter DC1 and a maximum outer diameter DC2. In an alternate embodiment, section C may have a substantially cylindrical outer shape with a constant outer diameter. Section C may include an anti-fraying design 24 to minimize wear from twisting of the cable 2 and repeated plugging/unplugging of the connector 1 to/from the vehicle's receptacle. In the embodiment shown, the anti-fraying design 24 includes a "fish bone" design having portions 24*a* that extend outwardly beyond the diameter D2 of the cable 2 and having at least one gap portion 24*b* between a pair of portions 24*a*. In one embodiment, shown, the minimum outer diameter DC1 is substantially larger than the outer diameter D2 of the cable 2. This provides structural rigidity to the connection end 12. In another embodiment the maximum outer diameter DC2 is juxtaposed to, and substantially the same as, the minimum outer diameter DB1 of section B. This provides a smooth surface transition between sections.

With reference now to FIGS. 2A, 2B, 2D, 3 and 4, the connector 1 may also have at least one handle surface 7 that can be used by an operator when plugging and unplugging the connection end 12. The handle surface 7 thus simplifies the use of the connector 1 by an operator. In one embodiment, the handle surface 7 includes at least one wing section 26 extending outwardly from the outer surface of either section A or section B. In another embodiment, shown, the wing section 26 extends from both sections A and B. This provides structural rigidity to the connection end 12. In yet another embodiment, also shown, a second wing section 26 extends outwardly from an opposite outer surface of either section A or section B. This provides a convenient pair of handle surfaces 7 for the operator and also increases the structural rigidity of the connection end 12. In another embodiment, the handle surface 7 includes at least one rib portion 28 extending outwardly from the outer surface of section B, as shown, or from the outer surface of section C. In another embodiment, shown, a pair of rib portions 28 extend outwardly from opposite outer surfaces of either section B or section C. This provides a convenient pair of handle surfaces 7 for the operator and also increases the structural rigidity of the connection end 12. In another embodiment, the rib portion 28 has a substantially elliptical cross-sectional shape with an outer surface that extends outward beyond the outer surface of either section B, shown, or section C. In another embodiment, the pair of rib portions 28 have outer surfaces separated by a distance D7 substantially equal to the outer diameter DA of section A. This provides for easy to use handle surfaces 7. In yet another embodiment, the handle surface 7 includes both one or more wing sections 26 and one or more rib portions 28.

With reference to all the FIGURES, in one embodiment, the connector 1 is designed to permit a maximum current draw of about 35 amps. With this reduced current draw limit, the connector 1 can be formed of a compact size and formed with minimal cost. The connector 1 of this invention is roughly half the size and weight of known slave connectors. The dimensional units provided in FIG. 2A are in millimeters (mm) unless followed by the symbol (") which indicates inches. Thus, for example, the fish bone design 24 is 31.75 mm or 1.25 inches in length. It is to be understood that all dimensional units provided are non-limiting examples only. The connector 1 may be supplied in a bag 6 and may include a tie 5 to hold the cable end 14 in place, as shown in FIG. 2D.

Multiple embodiments have been described, hereinabove. It will be apparent to those skilled in the art that the above methods and apparatuses may incorporate changes and modifications without departing from the general scope of this invention. It is intended to include all such modifications and alterations in so far as they come within the scope of the appended claims or the equivalents thereof.

We claim:

1. A NATO slave connector comprising:

a 2-conductor 10 gauge cable designed to permit a maximum current draw of about 35 amperes;

a connection end that engages a military vehicle's 24 volt battery NATO slave receptacle, the connection end comprising first, second, and third sections along its length:

(a) the first section being positioned at the terminal and of the connection end and comprising:

(1) a ring member having a continuous inner surface providing an electric contact surface and only one dimple extending inwardly from the inner surface for use in improving the electrical connection between the inner surface of the ring member and an associated male component of the NATO slave receptacle;

(2) a contact pole substantially axially centered within the ring member;

(3) a pair of wing sections extending from opposite sides of an outer surface of the first section and providing handle surfaces that can be used by an operator when plugging and unplugging the connection end;

(b) the second section being positioned between the first and third sections and comprising: a pair of rib portions extending outwardly from opposite sides of the cable that provide structural rigidity;

(c) the third section being positioned juxtaposed to the second section and comprising: a fish bone design that minimizes wear from twisting of the cable;

a cable end adapted to be wired to a device; and, a protective covering on the outer surface of the connector.

2. The NATO slave connector of claim 1 wherein:

the first section has a substantially cylindrical outer shape;

the second section has a substantially frusto-conical shape; and, the third section has a substantially frusto-conical shape.

3. The NATO slave connector of claim 1 wherein the pair of wing sections extend along a plane that is offset at substantially 90° from a plane along which the pair of rib portions extend.

4. The NATO slave connector of claim 1 wherein the second section has a maximum outer diameter, excluding the pair of rib portions, that is substantially smaller than an outer diameter of the first section, excluding the pair of wing sections.

5. The NATO slave connector of claim 1 wherein the second section has a minimum outer diameter, excluding the pair of rib portions, that is substantially larger than an outer diameter of the cable.

6. The NATO slave connector of claim 1 wherein the pair of wing sections also extend from opposite sides of an outer surface of the second section.

7. The NATO slave connector of claim 1 wherein the pair of rib portions have a substantially elliptical cross sectional shape.

8. The NATO slave connector of claim 7 wherein the pair of rib portions have outer surfaces separated by a distance that is substantially equal to an outer diameter of the first section.

9. The NATO slave connector of claim 1 wherein the ring member and the contact pole are formed of copper with brass plated nickel.

10. The NATO slave connector of claim 9 wherein the ring member and the contact pole are zinc plated.

11. The NATO slave connector of claim 1 wherein the protective covering is formed of polyvinyl chloride (PVC).

* * * * *